US009899163B2

(12) United States Patent
Agata et al.

(10) Patent No.: US 9,899,163 B2
(45) Date of Patent: Feb. 20, 2018

(54) SWITCH UNIT AND GAME MACHINE

(71) Applicant: OMRON Corporation, Kyoto-shi, Kyoto (JP)

(72) Inventors: Takehiro Agata, Aichi (JP); Hiroyuki Onitsuka, Gifu (JP); Taichi Onoyama, Aichi (JP); Masaaki Sumi, Gifu (JP); Masataka Kimura, Aichi (JP)

(73) Assignee: OMRON Corporation, Kyoto (JP)

( * ) Notice: Subject to any disclaimer, the term of this patent is extended or adjusted under 35 U.S.C. 154(b) by 145 days.

(21) Appl. No.: 15/130,608

(22) Filed: Apr. 15, 2016

(65) Prior Publication Data

US 2016/0335843 A1 Nov. 17, 2016

(30) Foreign Application Priority Data

May 14, 2015 (JP) ..... 2015-099493

(51) Int. Cl.

| | |
|---|---|
| ***H01H 13/72*** | (2006.01) |
| ***H01H 13/83*** | (2006.01) |
| ***G07F 17/32*** | (2006.01) |
| ***G07F 17/34*** | (2006.01) |

(52) U.S. Cl.

CPC ..... *H01H 13/83* (2013.01); *G07F 17/3209* (2013.01); *G07F 17/3211* (2013.01); *G07F 17/34* (2013.01); *H01H 2219/032* (2013.01)

(58) Field of Classification Search

USPC ..... 200/305

See application file for complete search history.

(56) References Cited

U.S. PATENT DOCUMENTS

| | | | | |
|---|---|---|---|---|
| 2014/0008188 | A1 | 1/2014 | Sakamoto et al. | |
| 2016/0335844 | A1* | 11/2016 | Onoyama | H01H 13/83 |
| 2016/0335845 | A1* | 11/2016 | Onoyama | G02B 6/0051 |

FOREIGN PATENT DOCUMENTS

| | | |
|---|---|---|
| JP | 2012-200343 A | 10/2012 |

* cited by examiner

*Primary Examiner* — Renee Luebke
*Assistant Examiner* — Lheiren Mae A Caroc
(74) *Attorney, Agent, or Firm* — Osha Liang LLP

(57) ABSTRACT

A switch unit has a display part configured to display an image, and an operation part provided on the display part in a stacked manner. The operation part includes a button made of a transparent material except for an edge, a transparent button case having an opening formed in a position corresponding to a display region of the display part and configured to position the button, and a transparent substrate provided below the button case and having an electronic component disposed in a position corresponding to the edge of the button. The button is disposed on the transparent substrate via the opening in the button case. A discharge gap in parallel with the electronic component is provided on a wire in a position corresponding to the edge of the button on the transparent substrate.

16 Claims, 8 Drawing Sheets

SWITCH UNIT AND GAME MACHINE

CROSS-REFERENCE TO RELATED APPLICATION

This application is based on Japanese Patent Application No. 2015-099493 filed with the Japan Patent Office on May 14, 2015, the entire contents of which are incorporated herein by reference.

BACKGROUND

Field

The present invention relates to a switch unit and a game machine.

Related Art

A game machine called a slot machine has hitherto been known. In the slot machine, a plurality of reels displaying a plurality of types of symbols are spun, and a winning combination is determined based on a matching pattern of symbols and the matched symbols at the stopping of the reels. A prize is then given to a player in accordance with the winning combination and the number of bets.

Operation such as setting of the number of bets and the start of the spinning of the reels is performed by pressing down a button included in a switch unit provided in the slot machine. Unexamined Japanese Patent Publication No. 2012-200343 (published in Oct. 22, 2012) discloses a technique of displaying an image in a switch unit so as to appeal to a player and thereby attract a large number of people. Specifically, in the switch unit disclosed in Unexamined Japanese Patent Publication No. 2012-200343, lenses are provided between a display part and operation keys to display an image on the operation keys.

However, in Unexamined Japanese Patent Publication No. 2012-200343, a sufficient appeal to a player is not expected due to a limited proportion of the operation keys, on which an image is to be displayed, relative to the entire switch unit. In order to further increase the appeal to a player, it can be considered that a button case and the like surrounding the operation keys are made of a transparent member to make the entire display part usable.

In this case, the lens becomes unnecessary, and the operation key can be made thinner, thereby reducing cost. However, because of the smaller thickness, when the operation key is pressed down by a charged finger, a current transmitted from the finger to the button causes occurrence of creeping discharge from the button to the button case. With such discharge, a larger current than usual flows in a circuit inside the button to cause a failure of an electronic component.

SUMMARY

A switch unit according to one or more embodiments of the present invention and a game machine according to one or more embodiments of the present invention may be capable of preventing a failure of an electronic component caused by static electricity and providing a sufficient appeal to a player.

A switch unit according to one or more embodiments of the present invention comprises a display part configured to display an image, and an operation part provided on the display part in a stacked manner. The operation part includes a button made of a transparent material except for an edge, a transparent button case having an opening formed in a position corresponding to a display region of the display part and configured to position the button, and a transparent substrate provided below the button case and having an electronic component disposed in a position corresponding to the edge of the button. The button is disposed on the transparent substrate via the opening in the button case. A discharge gap in parallel with the electronic component is provided on a wire in a position corresponding to the edge of the button on the transparent substrate.

According to the above configuration, the button which is transparent except for its edge is disposed in the opening in the transparent button case. Hence it is possible to display a display image of the display part inside the button and on the periphery of the button, so as to extend an image projectable range. Further, since the electronic component and the discharge gap are disposed in the positions corresponding to the edge of the button, they do not affect the display of the display part. Hence it is possible to provide a sufficient appeal to the player.

Further, when the button is pressed down by a charged finger of the player, creeping discharge may occur. However, providing the discharge gap in parallel with the electronic component can prevent a current higher than usual from flowing in the electronic component, so as to prevent occurrence of a failure of the electronic component.

Hence it is possible to provide a switch unit and a game machine capable of preventing a failure of the electronic component caused by static electricity and providing a sufficient appeal to the player.

Further, in the switch unit of the present invention, it is preferable that a plurality of the buttons be provided, and a plurality of the openings spaced from each other be formed in the button case.

Further, according to the above configuration, an image can also be displayed between the buttons, thereby providing a sufficient appeal to the player.

Further, in the switch unit of the present invention, it is preferable that a length of the discharge gap range from 0.1 mm to 0.2 mm.

Further, in the switch unit of the present invention, it is preferable that a height of the button with respect to the transparent substrate be not larger than 12 mm.

Further, in the switch unit of the present invention, it is preferable that the electronic component be a light emitting element.

According to the above configuration, a light performance can be made by the light emitting element at the edge of the button, thus providing a sufficient appeal to the player.

The present invention exerts the effect of being able to prevent a failure of an electronic component caused by static electricity and to provide a sufficient appeal to the player.

DETAILED DESCRIPTION

Figure 1:
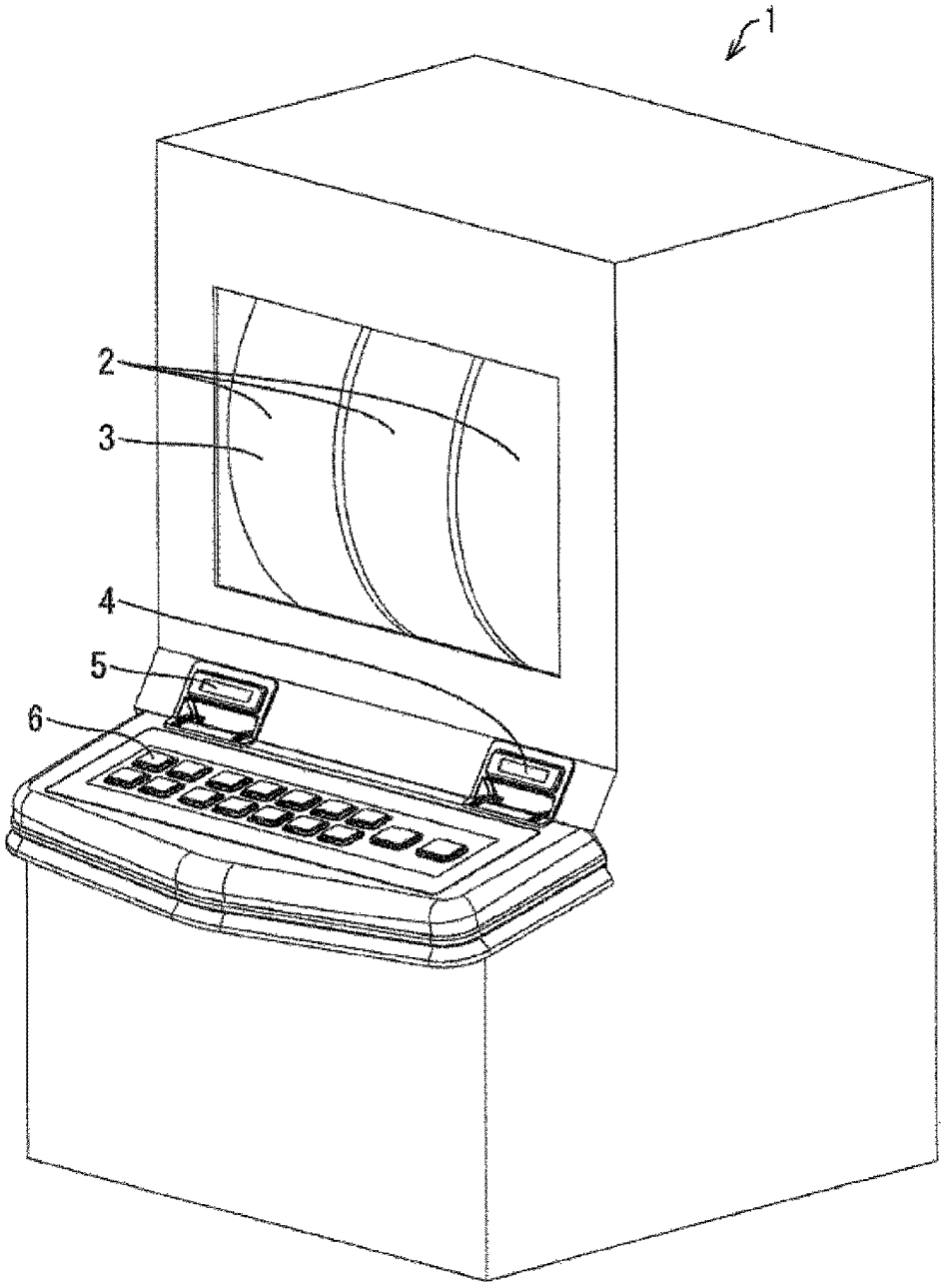
FIG. 1 illustrates a configuration of a slot machine according to an embodiment.

Embodiments of the invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 illustrates a configuration of a slot machine 1 as a game machine according to an embodiment. As illustrated in FIG. 1, the slot machine 1 includes a reel part 2 disposed in an upper part of a casing, a bill inlet 4, a ticket outlet 5, and a switch unit 6 disposed near the reel part 2. In the slot machine 1, a bill is inserted into the bill inlet 4, and after a play, a ticket is ejected through the ticket outlet 5 when conditions for winning a prize are satisfied during the play.

The reel part 2 includes a plurality of reels provided laterally side by side, and repeats spinning and stopping for each play. The reel displays a plurality of types of symbols, and a player can receive a prize in accordance with a winning combination that is specified based on a matching pattern of symbols at the stopping of all the reels. In addition, the reel part 2 may include the reels themselves or may be configured to display an image corresponding to the reels on a display screen 3.

The switch unit 6 accepts operation performed by the player. Specifically, the switch unit 6 includes a button for setting of an increase or a decrease in number of bets during a play, a button for instruction of spinning of the reels which is a play starting sign, and some other buttons.

Figure 2:
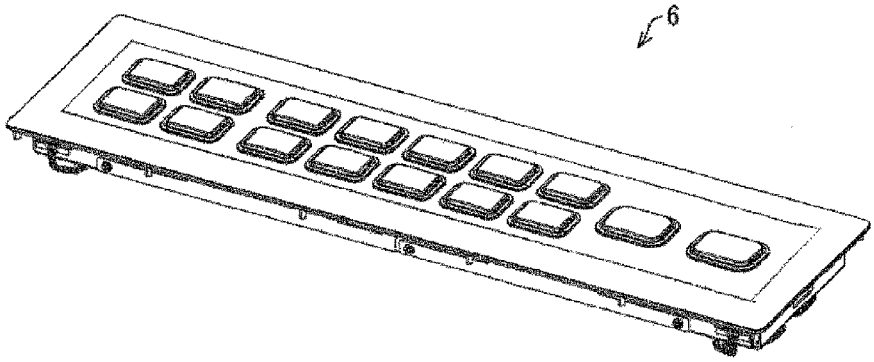
FIG. 2 is a perspective view of a switch unit.
Figure 3:
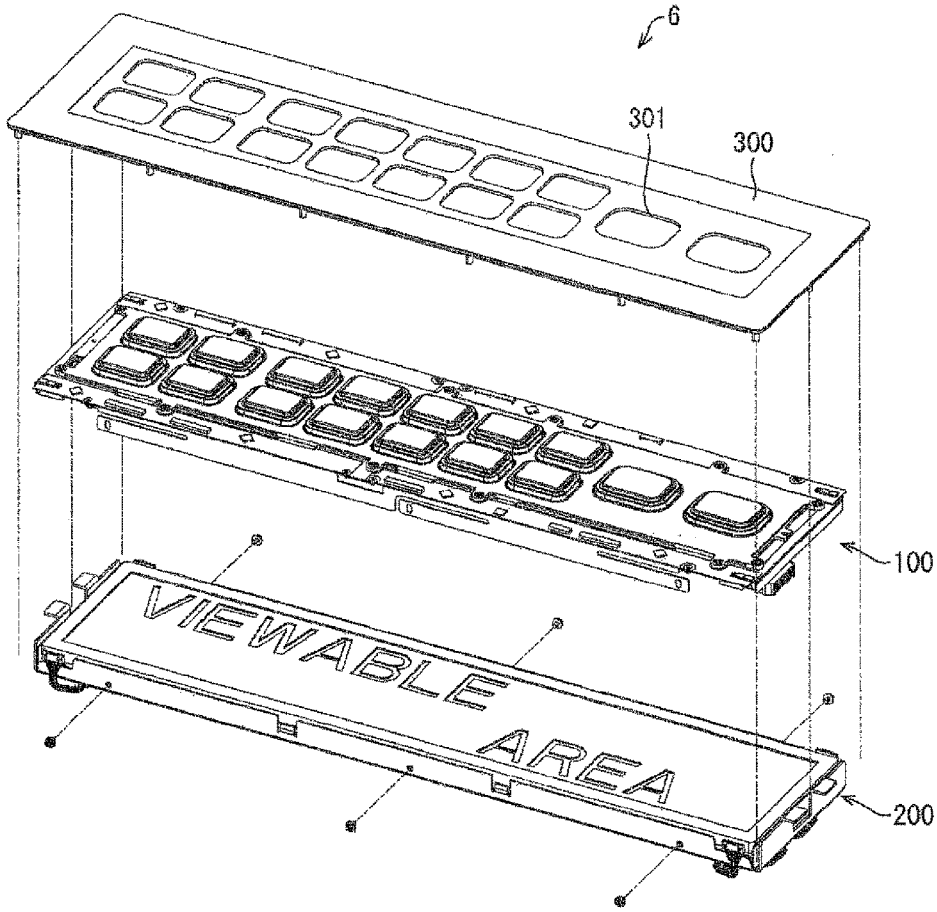
FIG. 3 is an exploded perspective view of the switch unit.

FIG. 2 is a perspective view of the switch unit 6. FIG. 3 is an exploded perspective view of the switch unit 6. As illustrated in FIG. 3, the switch unit 6 includes an operation part 100, a display part 200 provided therebelow, and a top plate 300.

The display part 200 is a display device such as a liquid crystal display (LCD), and displays image data concerning a game. For example, the display part 200 displays images of functions of buttons in the operation part 100 disposed thereabove, a game presentation, the characters that appear in the game, and the like. Thereby, the display part 200 can appeal to the player to play with its own device.

Each member of the operation part 100 is made of a transparent material except for a part thereof. Accordingly, the player can view an image displayed by the display part 200 through the operation part 100. Further, the operation part 100 includes various buttons. Specifically, the operation part 100 includes a bet button for inputting the number of bets, and a spin button for instructing the start of the game.

The top plate 300 is a cover provided on the upper surface of the operation part 100. The top plate 300 is provided with openings 301 respectively corresponding to the positions of the buttons so that buttons protrude from the upper surface of the top plate 300. Further, the top plate 300 is made of a transparent material except for its peripheral edge.

Figure 4:
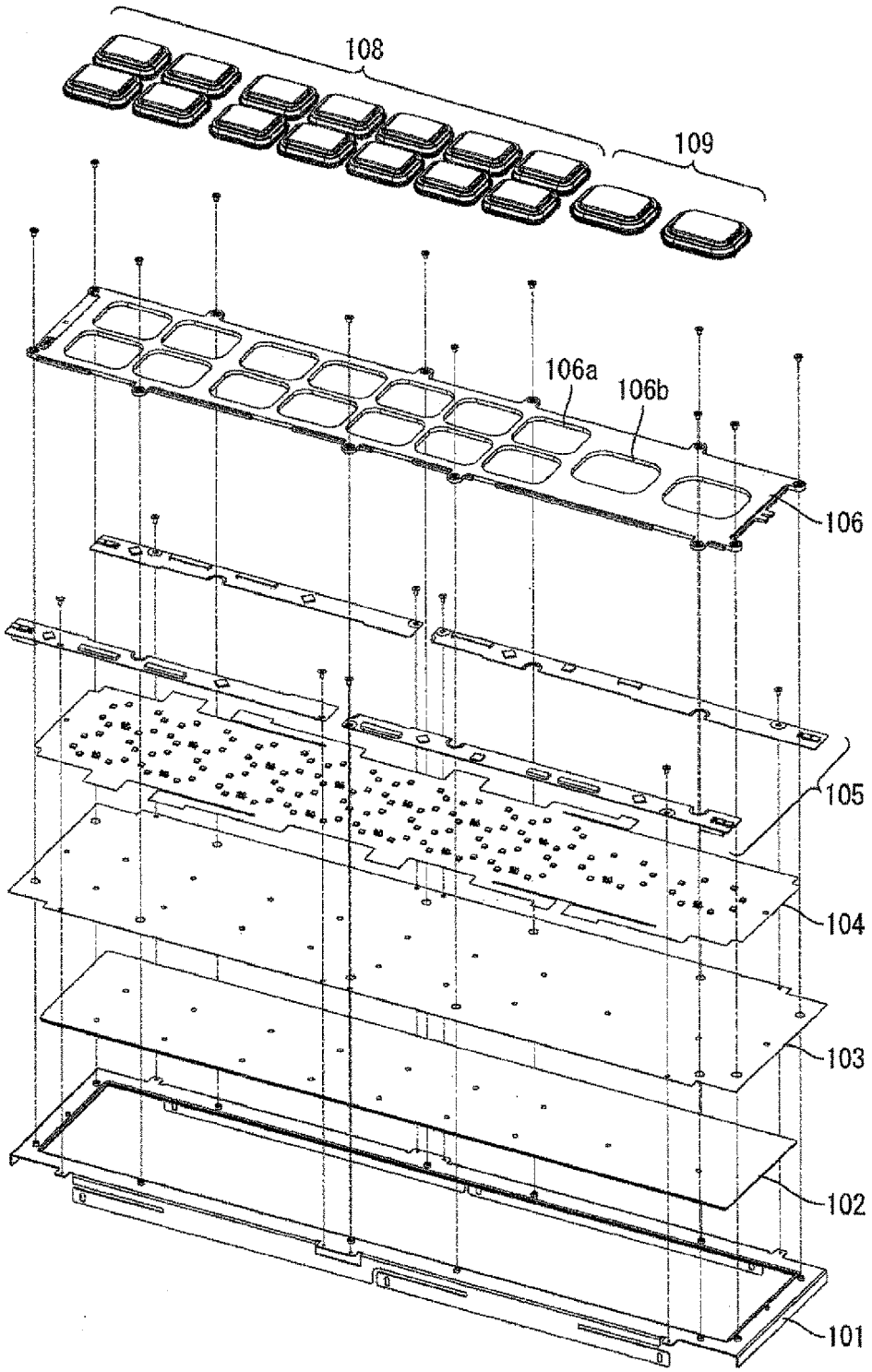
FIG. 4 is an exploded perspective view illustrating an example of a configuration of an operation part.

FIG. 4 is an exploded perspective view illustrating an example of a configuration of the operation part 100. As illustrated in FIG. 4, the operation part 100 includes bet buttons 108 and spin buttons 109 which are made of a transparent material except for edges thereof, and includes a button base part where the buttons 108 and 109 are disposed. The button base part is formed of transparent plastic or the like, for example, and formed by stacking a base frame 101, a spacer 102, an insulating sheet 103, a transparent substrate 104, an LED control board 105, and a switch base 106 in this order and fixing them with screws or the like.

The switch base 106 is made of a transparent material. A plurality of openings 106*a*, 106*b* for positioning the bet buttons 108 and the spin buttons 109 are formed so as to be spaced from each other in positions corresponding to a display region of the display part 200. The bet buttons 108 and the spin buttons 109 are fitted into the openings 106*a*, 106*b*. The buttons 108, 109 are then disposed on the transparent substrate 104 via (through) the openings 106*a*, 106*b* of the switch base 106. As described above, the buttons 108, 109 are disposed on the transparent substrate 104 in a mutually independent manner. Thus, even when a failure, damage, or the like occurs in either the button 108 or the button 109, that button may only be replaced, thereby facilitating the maintenance. Further, since the plurality of openings 106*a*, 106*b* are formed so as to be spaced from each other in the switch base 106, the player can view a display image of the display part 200 even between the buttons 108, 109, thereby enabling enhancement of the performance effect.

As described above, in the embodiment, the buttons 108, 109 which are transparent except for the edges thereof are disposed in the openings 106*a*, 106*b* of the switch base 106 made of the transparent material. It is thereby possible to display the display image of the display part 200 inside the buttons 108, 109 and on the peripheries of the buttons 108, 109 (i.e., between the plurality of buttons 108, 109), so as to have the player view a larger image. As a result, it is possible to increase the appeal to the player.

Figure 5:
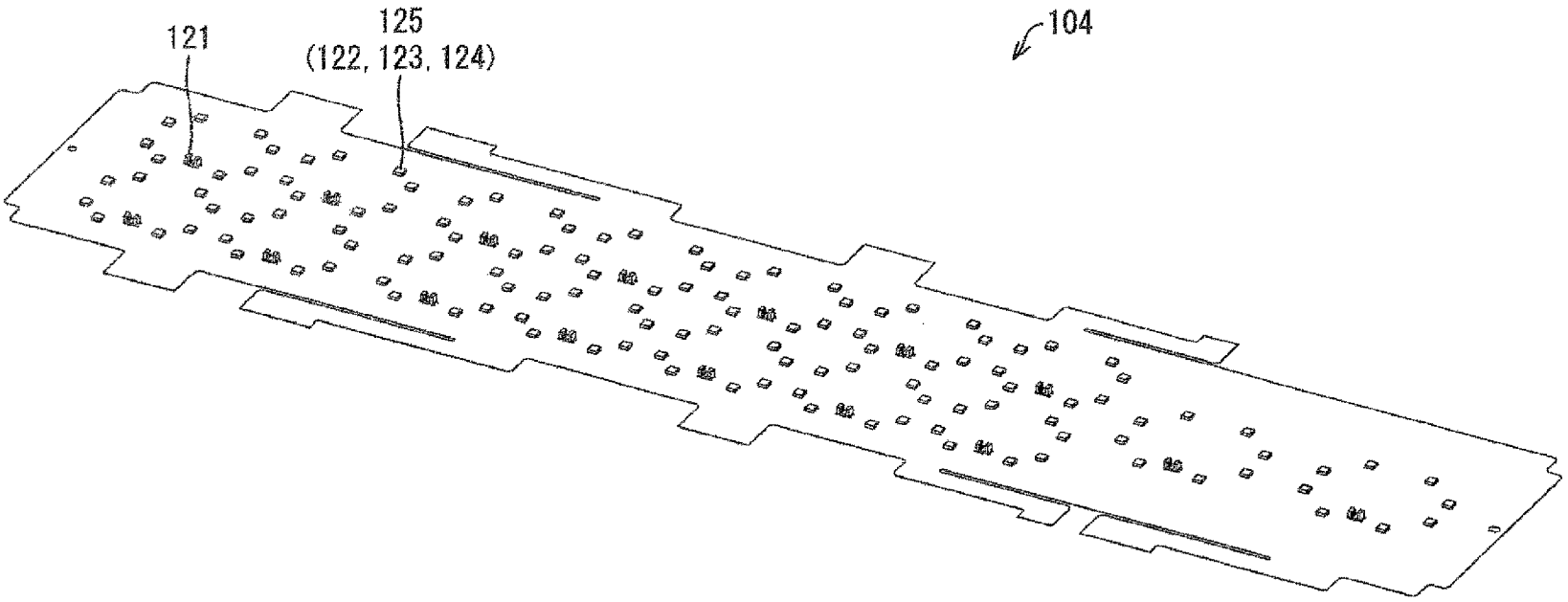
FIG. 5 is a perspective view illustrating an example of a transparent substrate.

FIG. 5 is a perspective view illustrating an example of the transparent substrate 104. As illustrated in FIG. 5, the transparent substrate 104 is made of a transparent material. On one surface thereof where the buttons 108, 109 are provided, full-color LEDs (light-emitting diodes) 125 and photo-sensors 121 are mounted as electronic components so as to be placed in positions along the peripheral edge of each of the buttons 108, 109. Wires (not illustrated in FIG. 5) for feeding electricity to the electronic components are formed. Specifically, a plurality of full-color LEDs 125 and the photo-sensor 121 are provided for each of the buttons 108, 109 along the edge (outline) thereof.

The full-color LED 125 includes light emitting elements 122 to 124 with colors of R (red), G (green), and B (blue), respectively. The transparent substrate of the embodiment is configured such that eight full-color LEDs 125 are provided for each of 16 buttons 108, 109.

The photo-sensor 121 includes a light emitting part which is a light emitting element and a light receiving part which is a photodiode for receiving light emitted from the light emitting part. By being configured such that a sensing object shields light between the light emitting part and the light receiving part, the photo-sensor 121 determines an on-state and an off-state of the operation part 100.

Figure 6:
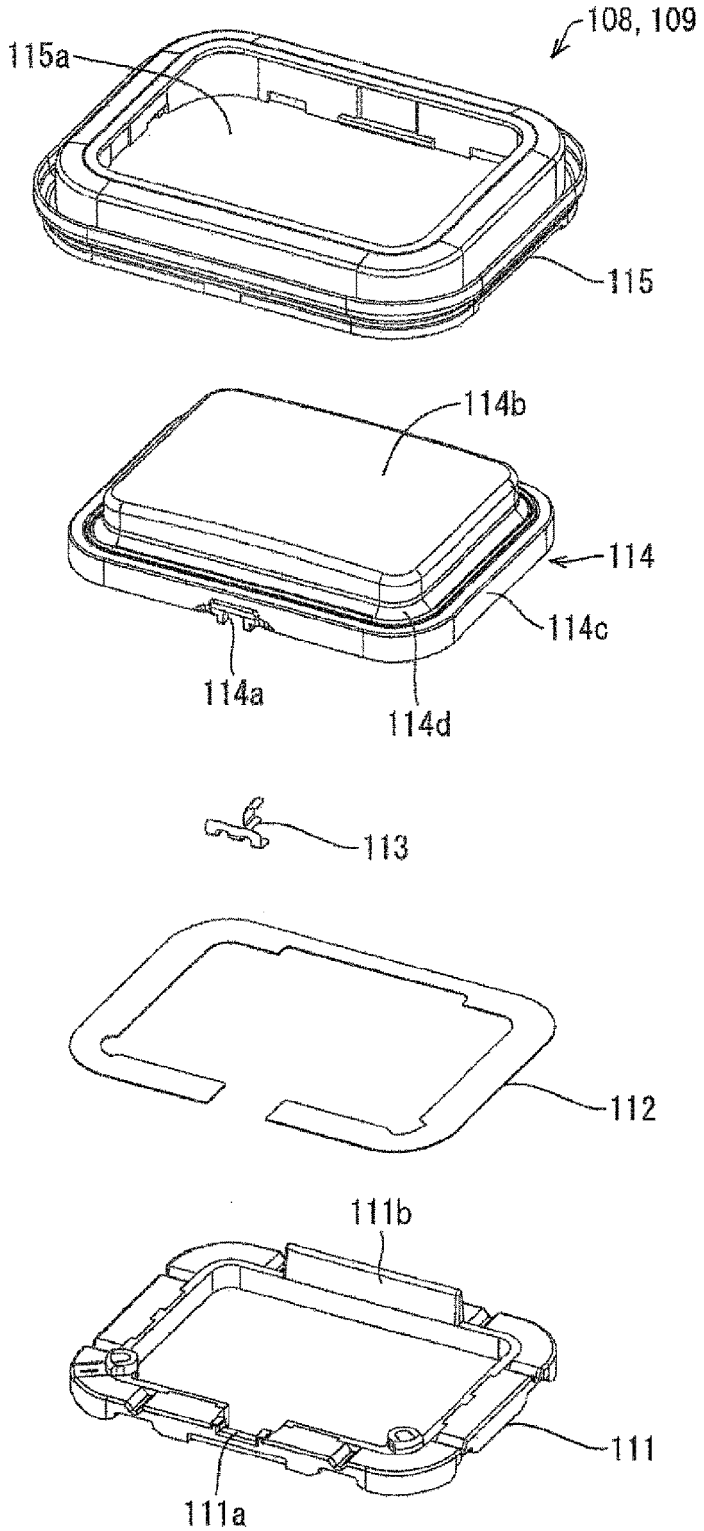
FIG. 6 is an exploded perspective view illustrating an example of a button included in the operation part.

FIG. 6 is an exploded perspective view illustrating an example of the buttons 108, 109 included in the operation part 100. As illustrated in FIG. 6, each of the buttons 108, 109 has a rectangular shape. A performance part 111, a diffusion part 112, a light shielding piece 113, a button body 114, and a cover 115 are stacked in this order and provided on the transparent substrate 104.

The cover 115 has an opening 115*a*, and the button body 114 is fitted into the opening 115*a*. The button body 114 is to be pressed down by a finger. The button body 114 includes a transparent key top 114*b*, a rectangular frame-like support

114*c* for supporting the key top 114*b*, and an elastomer part 114*d* for coupling the key top 114*b* with the support 114*c*. When pressing force is applied to the key top 114*b*, the elastomer part 114*d* made of elastomer is bent and transformed, and only the key top 114*b* is pressed downward. Further, when the pressing force to the key top 114*b* is removed, the key top 114*b* is pushed up upward due to elastic force of the elastomer part 114*d*, and thereafter returned to its fixed position. Moreover, an attachment part 114*a* for attachment of the light shielding piece 113 is formed on one surface (lower surface) of the support 114*c* where the diffusion part 112 is to be provided.

The diffusion part 112 has a substantially C-shape with a cut portion for placement of the light shielding piece 113 formed in a frame body and is provided along the lower surface of the support 114*c* in the button body 114. Further, the diffusion part 112 diffuses light from the performance part 111 provided therebelow so as to extend the light to the periphery of the button.

The performance part 111 has a rectangular shape and is provided along the diffusion part 112. The performance part 111 is provided above the full-color LEDs 125 and the photo-sensor 121 mounted on the transparent substrate 104 and has a function as a light guiding part for guiding light emitted by the full-color LEDs 125. The case of providing two full-color LEDs 125 on each side of the performance part 111 is shown here, but the configuration is not limited thereto.

Further, in the performance part 111, a recessed portion 111*a* is formed at a position facing the attachment part 114*a* included in the button body 114. The light shielding piece 113 is held by being interposed between the attachment part 114*a* and the recessed portion 111*a*. Moreover, the light shielding piece 113 has a substantially T-shape and is attached with its vertical portion turning to the inside of the performance part 111.

Furthermore, the performance part 111 has a projection 111*b* for supporting the button body 114 from below on the opposite side to the portion having the recessed portion 111*a*.

Figure 7:
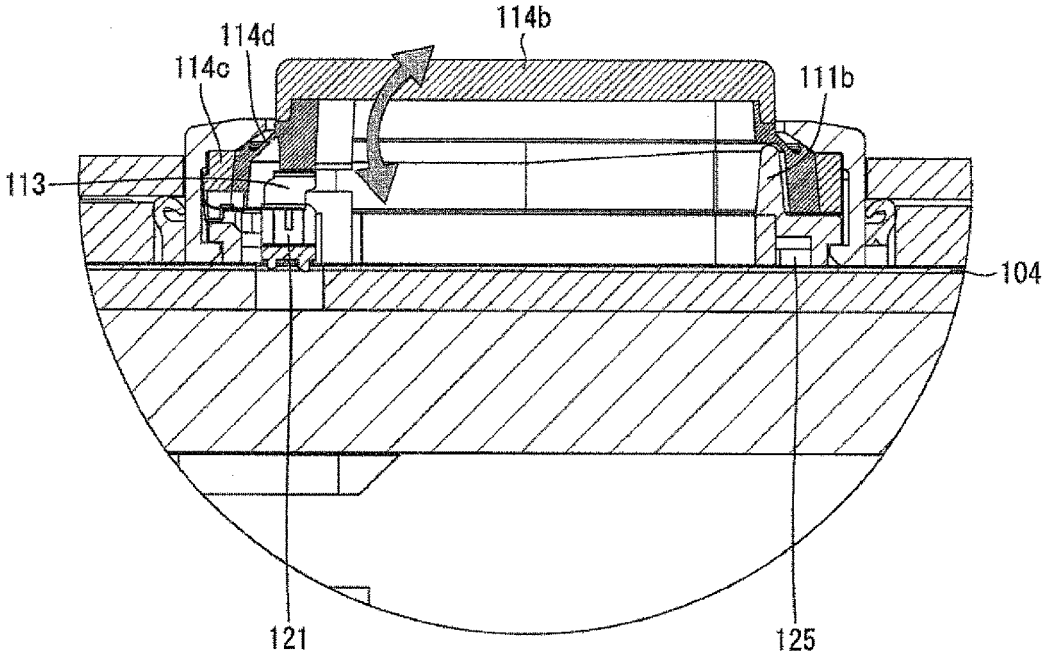
FIG. 7 illustrates a cross section of the button.

FIG. 7 illustrates a cross section of the buttons 108, 109. As an arrow in FIG. 7 indicates, when the key top 114*b* of each of the buttons 108, 109 is pressed down from the upper surface by the player, the one side of the key top 114*b* having the projection 111*b* is not pressed down, while the other side thereof having the light shielding piece 113 is pressed down due to bending transformation of the elastomer part 114*d*. At this time, the key top 114*b* abuts onto the light shielding piece 113 and presses down the light shielding piece 113. Accordingly, the vertical portion of the substantially T-shaped light shielding piece 113 gets into between the light emitting part and the light receiving part of the photo-sensor 121 to shield light from the light emitting part toward the light receiving part. The on-state of the button body 114 is thereby detected. On the other hand, when the button body 114 is not pressed down, the light receiving part is receiving light from the light emitting part, and the off-state is thereby detected.

Figure 8:
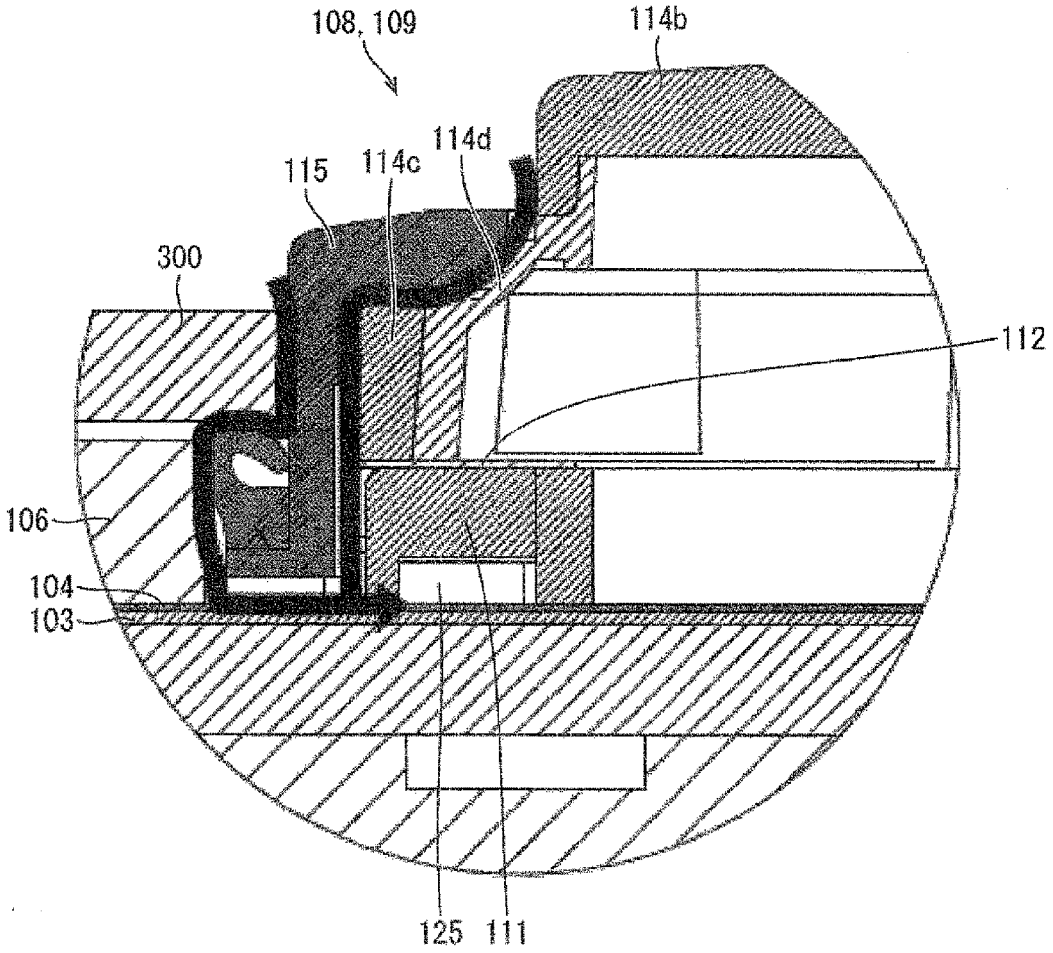
FIG. 8 illustrates a cross section of the button, indicating a route of creeping discharge.

FIG. 8 illustrates a cross section of the peripheral edge of the buttons 108, 109. As illustrated in FIG. 8, the cover 115, the elastomer part 114*d*, the support 114*c*, the performance part 111, and the diffusion part 112 are provided at the peripheral edge of the transparent key top 114*b* in each of the buttons 108, 109. The cover 115, the elastomer part 114*d*, the support 114*c*, the performance part 111, and the diffusion part 112 described above constitute the edge of each of the buttons 108, 109. The full-color LED 125 is disposed in a position corresponding to the edge of each of the buttons 108, 109 on the transparent substrate 104. Hence it is possible to make the edge of each of the buttons 108, 109 emit light with various colors, so as to enhance the performance effect. It is to be noted that the player does not view the image of the display part 200 at the edge of each of the buttons 108, 109 since a luminescence performance is made by the full-color LED 125. However, the edge of each of the buttons 108, 109 accounts for a very small region of the display screen of the display part 200 and does not affect the display image of the display part 200.

Further, a thick line in FIG. 8 indicates how creeping discharge is transmitted. The creeping discharge may occur, for example, when the finger of the player which is charged with static electricity touches the operation part 100. According to the configurations of the recent operation parts, the material for the button case of the operation part is often a metal. Hence transmission of a current between the finger and the button prevents a failure of the electronic component inside the button.

In contrast, according to the configuration of the operation part 100 of the embodiment, in order to enhance the appeal to the player, the switch base 106 of the operation part 100, which corresponds to the button case, and the top plate 300 are made of a material such as transparent resin, the thickness of the operation part 100 is made small (the height of the upper surface of each of the buttons 108, 109 with respect to the transparent substrate 104 is not larger than 12 mm), and each of the buttons 108, 109 is disposed on the transparent substrate 104 via the switch base 106 and the opening in the top plate 300. Hence the shortest creeping distance between the finger having touched the upper surface of the operation part 100 and the transparent substrate 104 is a distance along the inside or the outside of the cover 115 as indicated by the thick line in FIG. 8. As a result, a current being transmitted from the finger to the button may flow to the transparent substrate 104. In order to deal with this, the embodiment has a configuration such that an excessive current generated through discharge is not allowed to flow from the button body 114 into the full-color LED 125 or the photo-sensor 121. This configuration is described with reference to FIG. 9.

Figure 9:
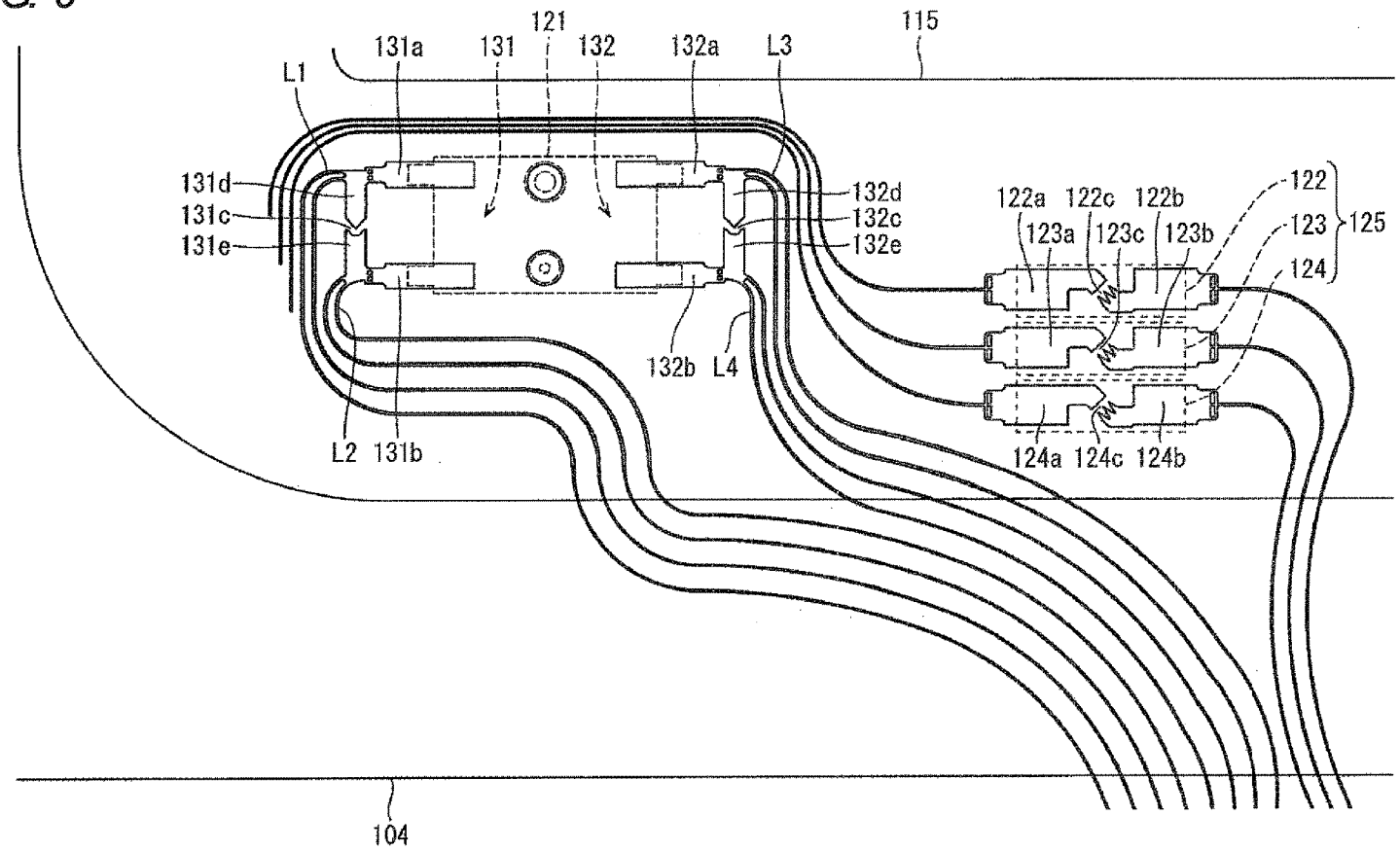
FIG. 9 is a plan view illustrating a photo-sensor and an LED provided on the transparent substrate.

FIG. 9 is a plan view illustrating wires on the transparent substrate 104. As illustrated in FIG. 9, the photo-sensor 121 is disposed above electrodes 131*a*, 131*b*, 132*a*, 132*b*. In the embodiment, the photo-sensor 121 is disposed on the transparent substrate 104 such that an input terminal of a light emitting part 131 is connected to the electrode 131*a*, an output terminal of the light emitting part 131 to the electrode 131*b*, an input terminal of a light receiving part 132 to the electrode 132*a*, and an output terminal of the light receiving part 132 to the electrode 132*b*.

Further, as illustrated in FIG. 9, the full-color LED 125 is disposed above electrodes 122*a*, 122*b*, 123*a*, 123*b*, 124*a*, 124*b*. In the embodiment, the full-color LED 125 is disposed on the transparent substrate 104 such that an input terminal of the R (red)-colored light emitting element 122 is connected to the electrode 122*a*, an output terminal of the light emitting element 122 is to the electrode 122*b*, an input terminal of the G (green)-colored light emitting element 123 is to the electrode 123*a*, an output terminal of the light emitting element 123 is to the electrode 123*b*, an input terminal of the B (blue)-colored light emitting element 124 is to the electrode 124*a*, and an output terminal of the light emitting element 124 is to the electrode 124*b*.

In the embodiment, as illustrated in FIG. 9, on the wires in positions corresponding to the edge of each of the buttons 108, 109 on the transparent substrate 104, the discharge gaps 131*c*, 132*c* are provided in parallel with respect to the light receiving part and the light emitting part of the photo-sensor 121, and the discharge gaps 122*c*, 123*c*, 124*c* are provided in parallel with respect to the light emitting elements 122 to 124. Specifically, a discharge electrode 131*d* connected to the electrode 131*a* and a discharge electrode 131*e* connected to the electrode 131*b* face each other, and the discharge gap 131*c* is formed between the electrodes 131*d*, 131*e*. Similarly, a discharge electrode 132*d* connected to the electrode 132*a* and a discharge electrode 132*e* connected to the electrode 132*b* face each other, and the discharge gap 132*c* is formed between the electrodes 132*d*, 132*e*.

Further, the electrode 122*a* and the electrode 122*b*, respectively connected to the input terminal and the output terminal of the light emitting element 122, are provided so as to face each other. The discharge gap 122*c* is formed between the electrodes 122*a*, 122*b*. Similarly, the electrode 123*a* and the electrode 123*b*, respectively connected to the input terminal and the output terminal of the light emitting element 123, are provided so as to face each other. The discharge gap 123*c* is formed between the electrodes 123*a*, 123*b*. Similarly, the electrode 124*a* and the electrode 124*b*, respectively connected to the input terminal and the output terminal of the light emitting element 124, are provided so as to face each other. The discharge gap 124*c* is formed between the electrodes 124*a*, 124*b*. The discharge gaps 131*c*, 132*c*, 122*c* to 124*c* are gaps for discharging static electricity so as to prevent it from flowing into the photo-sensor 121 and the light emitting elements 122 to 124. A length of the discharge gap is from 0.1 mm to 0.2 mm, for example. The discharge gaps 131*c*, 132*c*, 122*c* to 124*c* prompt discharge when a voltage not smaller than a predetermined value is applied to the wires connecting the photo-sensor 121 and the light emitting elements 122 to 124.

As described above, with the discharge gaps 131*c*, 132*c*, 122*c* to 124*c* provided, discharge passes over from the input side to the output side of each of the light emitting part 131 and the light receiving part 132 of the photo-sensor 121, and from the input side to the output side of each of the light emitting elements 122 to 124. Hence it is possible to prevent static electricity from flowing to the photo-sensor 121 and the light emitting elements 122 to 124. It is thereby possible to prevent occurrence of a failure of each of the photo-sensor 121 and the light emitting elements 122 to 124.

Further, the discharge gaps 131*c*, 132*c*, 122*c* to 124*c* are each provided between the electrodes having relatively large widths as described above. Placement of such electrodes on the display region of the display part 200 may make a display image difficult to view. However, in the embodiment, the discharge gaps 131*c*, 132*c*, 122*c* to 124*c* are provided at the edge of each of the buttons 108, 109, the edge being a region where the full-color LED 125 makes a luminescence performance. Hence it is possible to take countermeasures against static electricity without affecting the display of the display part 200.

The present invention is not limited to the above described embodiments, and various modifications can be made within the scope defined in the claims. An embodiment obtained by an appropriate combination of the technical methods disclosed respectively in the different embodiments is also included in the technical scope of the present invention.

The switch unit of the present invention is applicable to a game machine such as a slot machine.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A switch unit comprising:
a display part configured to display an image; and
an operation part provided on the display part in a stacked manner, wherein
the operation part includes:
a button made of a transparent material except for an edge,
a transparent button case having an opening formed in a position corresponding to a display region of the display part and configured to position the button; and
a transparent substrate provided below the button case and having an electronic component disposed in a position corresponding to the edge of the button,
the button is disposed on the transparent substrate via the opening in the button case, and
a discharge gap in parallel with the electronic component is provided on a wire in a position corresponding to the edge of the button on the transparent substrate.

2. The switch unit according to claim 1, wherein
a plurality of the buttons are provided, and
a plurality of the openings spaced from each other are formed in the button case.

3. The switch unit according to claim 2, wherein a length of the discharge gap ranges from 0.1 mm to 0.2 mm.

4. The switch unit according to claim 2, wherein a height of an upper surface of the button with respect to the transparent substrate is not larger than 12 mm.

5. The switch unit according to claim 2, wherein the electronic component is a light emitting element.

6. A game machine comprising the switch unit according to claim 2.

7. The switch unit according to claim 1, wherein a length of the discharge gap ranges from 0.1 mm to 0.2 mm.

8. The switch unit according to claim 7, wherein a height of an upper surface of the button with respect to the transparent substrate is not larger than 12 mm.

9. The switch unit according to claim 7, wherein the electronic component is a light emitting element.

10. A game machine comprising the switch unit according to claim 7.

11. The switch unit according to claim 1, wherein a height of an upper surface of the button with respect to the transparent substrate is not larger than 12 mm.

12. The switch unit according to claim 11, wherein the electronic component is a light emitting element.

13. A game machine comprising the switch unit according to claim 11.

14. The switch unit according to claim 1, wherein the electronic component is a light emitting element.

15. A game machine comprising the switch unit according to claim 14.

16. A game machine comprising the switch unit according to claim 1.

* * * * *